United States Patent [19]

Klemm

[11] Patent Number: 4,840,238

[45] Date of Patent: Jun. 20, 1989

[54] SUPERPOSED DRILLING DEVICE

[75] Inventor: Günter Klemm, Olpe, Fed. Rep. of Germany

[73] Assignee: Ing. Günter Klemm Spezialunternehmen für Bohrtechnik, Fed. Rep. of Germany

[21] Appl. No.: 230,230

[22] Filed: Aug. 9, 1988

[30] Foreign Application Priority Data

Aug. 25, 1987 [DE] Fed. Rep. of Germany ..... 3728269

[51] Int. Cl.[4] ..... E21B 4/14

[52] U.S. Cl. ..... 175/92; 173/64; 173/78; 173/80; 175/215; 175/296

[58] Field of Search ..... 175/92, 107, 108, 113, 175/135, 209, 210, 211, 215, 257, 296, 415; 173/64, 73, 78, 79, 80

[56] References Cited

U.S. PATENT DOCUMENTS 4,067,596 1/1978 Kellner et al. ..... 175/215 X 4,771,835 9/1988 Eaton ..... 175/215 X

*Primary Examiner*—William P. Neuder

*Attorney, Agent, or Firm*—Diller, Ramik & Wight

[57] ABSTRACT

In a scavenger is supplied through a scavenging pipe (26) to the internal pipe string (11), the scavenging pipe (25) extending through a bore (27) of the hammer piston (17) of the hammer drill. Due to a rotary drive (14), the drilling strings (10,11) are rotated which are connected to the shank (13) extending into the rotary drive (14). The scavenger is conducted through the scavenging pipe (26) into the shank (23) and from there into the internal pipe string (11). The external diameter of the scavenging pipe (26) is inferior to the inner diameter of the bore (27) of the hammer piston (17), and of the scavenging bore (23). Sealing between the scavenging pipe (26) and the scavenging bore (23) is effected by a thick head piece (33) at the end of the scavenging pipe. Said head piece (33) contains a seal rubbing along the cylindrical scavenging bore wall if the hammer piston (17) strikes on the shank (13). An annular chamber (35) at the head (33) forms a throttle point in order to reduce shock pressures acting on the seal.

8 Claims, 2 Drawing Sheets

SUPERPOSED DRILLING DEVICE

BACKGROUND OF THE INVENTION

Superposed drilling devices comprise an external pipe string and an internal pipe string extending coaxially thereto which, in common, are driven into rock or ground to produce a borehole whose wall is supported by the external pipe string. To backflush the bore material, a scavenger medium such as air or water is conducted through the internal pipe string and to the borehole bottom. The scavenger supplied to the internal pipe string is introduced through the hammer drill mounted at the rear end of the rotary drive. A scavenging pipe secured to the hammer drill housing traverse's a bore of the piston of the hammer drill to project into a scavenging bore of the shank receiving the blows of the hammer piston and being rotatingly driven by the rotary drive. The shank is integrally connected to the internal pipe string, and its scavenging bore communicates with the bore of the internal bore string.

In the known superposed drilling devices in which the scavenger is supplied through the hammer drill, the seal between scavenging pipe and scavenging bore is provided in an annular groove of the scavenging bore. The scavenging pipe rubs along said seal which is subjected to a high wear due to the continuous linear movements between shank and scavenging pipe, on the one hand, and due to the considerable pressure fluctuations and high pressure peaks to which the seal is exposed. While the piston of the hammer drill strikes the shank, the shank together with the pipe string connected thereto moves in axial direction, however, the column of scavenger medium in the pipe string is not accelerated. With each blow, the static pressure of the scavenger is superposed by a dynamic pressure which may be very high. Due to said high pressures, it is necessary to maintain a very close tolerance between the external diameter of the scavenging pipe and the diameter of the scavenging bore containing the moving scavenging pipe. In view of the impact stress for the shank, the material strains are considerable with the result, that the scavenging pipe is exposed to a high risk of break. As a matter of fact, a break of the scavenging pipe is very frequently responsible for the failure of the drilling device. Since the seal is provided in an annular groove of the shank receiving the blows of the hammer drill, the shank is weakened near the striking zone. Breaks of the shank are not unusual either accordingly.

Due to the foregoing difficulties, the scavenger supply through the hammer drill and through the shank were performed in the past by only allowing a maximum inner diameter of about 11 mm and a maximum pressure of the scavenger of about 7 bar, because, otherwise, there has been the risk of destroying the seal, the scavenging pipe or the shank. In view of the small diameter of the scavenger bore and of the low pressure, the amount of scavenger supplied through the inner pipe string has been insufficient for effective flushing. Therefore, in case of larger borehole diameters, additional scavenger has been introduced into the external pipe string through a scavenging ring which is retained relative to the rotating external pipe string.

The scavenger amounts supplied through the internal pipe string and the external pipe string are flushed back long the outside of the external pipe string thus entailing the risk of a wash-out of the borehole.

In case of superposed drilling, it is of interest to produce boreholes as big as possible at a high driving speed. A high scavenger flow rate is required to this effect. Due to the problems of tightness and stability, the scavenger channel of the known superposed drilling device may not be dimensioned big enough to guide a sufficiently high amount of scavenger only through the internal pipe string

SUMMARY OF THE INVENTION

It is the object of the invention to provide a superposed drilling device such as specified in the precharacterizing part of claim 1 which, without the risk of leakages and breaks of material may be operated at high pressures and with a big cross section of the scavenging channel.

The seal of the drilling device of the instant invention is provided in the thick head of the scavenging pipe rather than in an annular groove of said pipe. By this means, a wall weakening of the shank due to the annular groove receiving the seal is avoided. The scavenging pipe is not exposed to mechanical stress by blows so that the sealing groove provided in the outside of the head of the scavenging pipe does not cause a stability reducing effect. The external diameter of the scavenging pipe is inferior to the diameter of the scavenging bore so that slight shank inclinations with respect to the scavenging pipe are not transmitted through close fits to the scavenging pipe. Only in the area accommodating the seal, the external diameter of the head is adapted to the scavenging bore diameter. The axial length of said area being short, bending moments are not transmitted. Therefore, the shank may be inclined or tilted within certain limits with respect to the scavenging pipe which, nevertheless, will not be endangered accordingly. In the absence of any annular groove weakening the shank, the scavenging bore may be of a continuous cylindrical shape. In spite of a snug seat of the seal, the shank may somewhat move relative to the scavenging pipe.

In the pressure chamber, the head piece together with the wall of the scavenging bore forms an annular chamber having a cross section decreasing towards the seal. Said annular chamber forms an annular throttle point placed in advance of the seal and having a high flow resistance. If, during a blow of the hammer piston on the shank, a dynamic pressure is built up in the scavenging bore, part of said pressure is dissipated by the throttle effect of the annular chamber so that pressure peaks reaching the seal are considerably less high than the pressure peaks prevailing in the scavenging bore. As a result, the seal is relieved from short-time pressure peaks. Therefore, the scavenging bore design and the inner width of the scavenging pipe may be considerably larger than hitherto. Preferably, the diameter of the scavenging bore is at least about 25 mm. Since the pressure peaks caused by the hammer blows may be reduced, it is possible to operate at a higher static scavenger pressure which is preferably at least about 10 bar.

In the instant invention, it is possible, in view of the larger bore cross section and the higher pressures, to achieve a high scavenger flow rate with an exclusive scavenger supply through the hammer drill. Further, a considerable flushing pressure is still available at the borehole bottom. Therefore, it is not necessary to additionally supply scavenger to the external pipe, but the annular space between the external pipe string and the internal pipe string may be used for backflushing. Only the rear end of the external pipe string need be provided with discharge holes so that backflushed scavenger and bore material may escape from the rotating external pipe string. A scavenging bell or a scavenging ring retained nonrotatingly are not required. Therefore, the adapter used to connect the external pipe string to the shank may be short. The discharge holes are preferably provided in the adapter whose outer diameter need not be substantially larger than that of the external pipe line.

Embodiments of the invention will be explained hereunder in more detail with reference to the drawings in which

DESCRIPTION OF THE PREFERRED EMBODIMENTS

Figure 1:
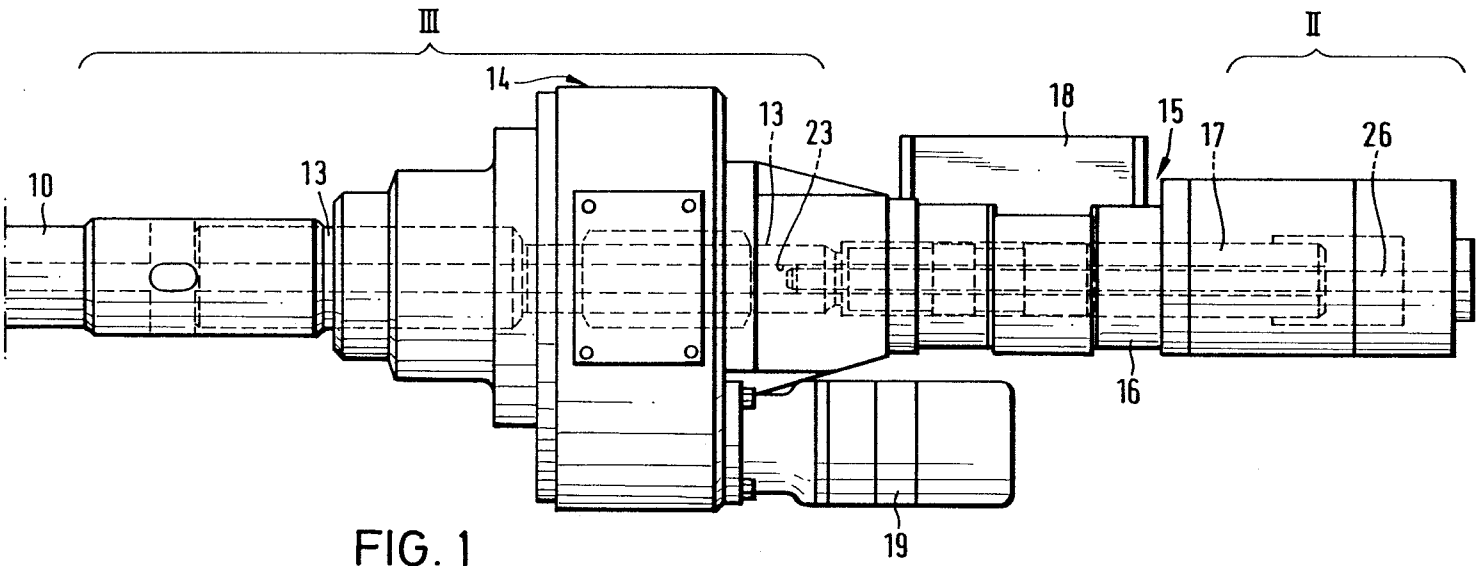
FIG. 1 is a plan view of the drilling device.

The superposed drilling device comprises an external pipe string 10 and an internal pipe string 11 extending coaxially thereto. Each of the pipe strings 10,11 may consist of pipe portions interconnected by coupling members, the ends of the pipe strings 10, 11 being provided with (non-illustrated) drill bits.

By an adapter 12, both pipe strings 10,11 are joined to a shank 13 projecting axially through the rotating drive 14 in order to transmit the rotating power to both pipe strings 10, 11. At the rear end of the housing of the rotating drive 14, there is fixed the hammer drill 14 which, in a hammer casing 16, accomodates an axially displaceable piston 17 striking on the rear end of the shank 13. The piston 17 is hydraulically operated by the hammer control 18 in order to alternatingly perform a working stroke and a return stroke. Since hydraulic drill hammers are known, a detailed description thereof is unnecessary here.

The hydraulic torque motor 19 rotates via a gear 20 a larger gear 21 traversed by the shank 13. A multisplined toothing 22 of the shank 13 meshes with a corresponding multisplined toothing inside the gear 21 so that the rotatingly driven gear 21 transmits the rotation to the shank 13, while axial movements of the latter relative to gear 21 or to the rotary drive 14 are possible. The shank 13 is a tubular member which comprises a scavenging bore 23 extending over its total length and which is disposed in the housing of the rotary drive 14. A seal 24 seals the hammer casing against the interior of the rotary drive, and another seal 25 seals the exit of the shank 13 from the housing of the rotary drive 14.

Figure 2:
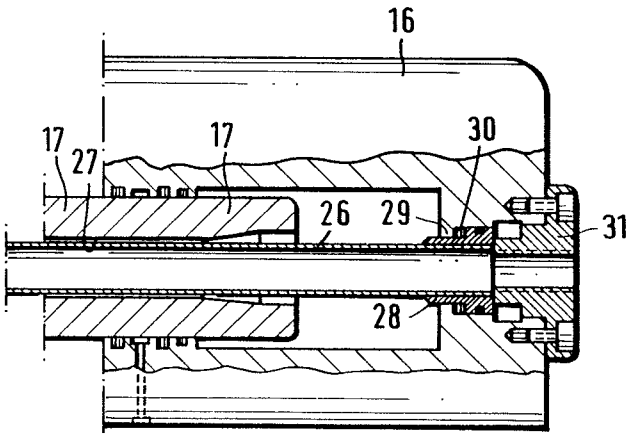
FIG. 2 is a longitudinal section of region II of FIG. 1, namely a longitudinal section of the rearward portion of the hammer drill, FIG. 3 a partial longitudinal section of the front region III of the drilling device.

From the rearward end, the seavenging pipe 26 extending into the scavenging bore 23 projects through a longitudinal bore 27 of the hammer piston 17 and its rear end is held at the hammer casing 16. As evident from FIG. 2, a sleeve 28 welded to the rear end of the scavenging pipe 26 is supported at an annular shoulder 29 of the end wall of casing 16 by means of an elastomeric support ring 30, said sleeve 28 being pressed against the support ring 30 by a connecting piece 31 fixed by screwing to the rear wall of casing 16. It is possible to join to the connecting piece 31 a feed line for the supply of scavenger. The support ring 30 allows slight oscillating movements of the scavenging pipe 26 relative to housing 16.

Figures 3, 4, 5:
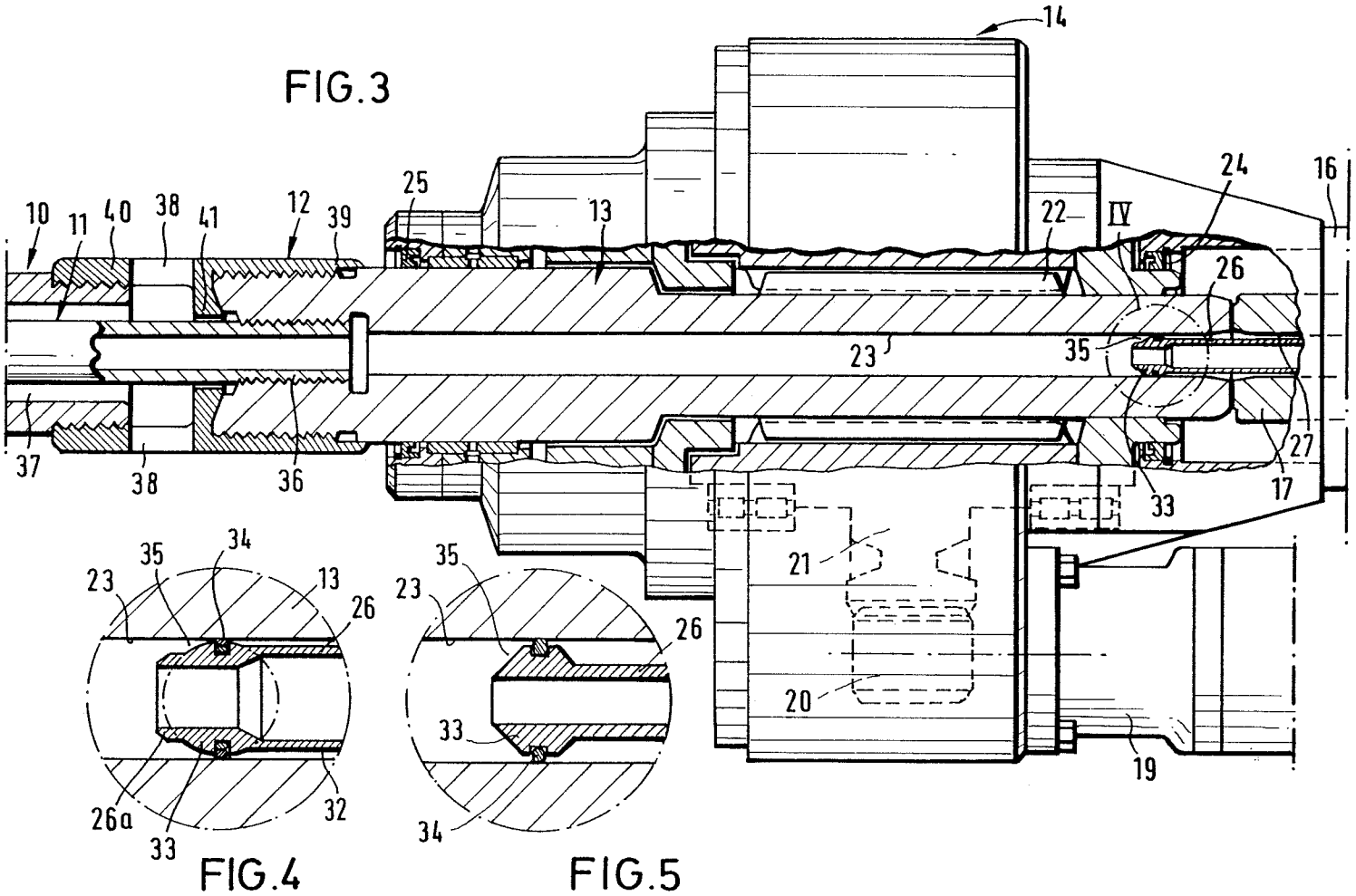
FIG. 4 is a scaled-up view of region IV of FIG. 3
FIG. 5 is another embodiment of the scavenging pipe head shown in FIG. 4.

Between the scavenging pipe 26 and bore 27 of the hammer piston 17, there is an annular chamber. Thus, the support pipe 26 is slightly movable radially with respect to the hammer piston 17. Another annular chamber 32 is between the scavenging pipe 26 and the scavenging bore 23 (FIG. 4). The diameters of the scavenging bore 23 and of bore 27 are equal. At the end of the scavenging bore 26, there is a thick head 33 whose outer surface is partly spherical in the instant embodiment. Said head 33 is joined by a short end section **26*a* of the scavenging pipe 26. Within the range of the maxi diameter of head 33, there is an annular groove for the seating of the annular seal 34 which rubs along the wall of the scavenging bore 23. In the area of the seal 34, the diameter of head 33 is only slightly inferior to that of the scavenging bore 23. In advance of seal 34, said head 33 forms an annular chamber 35 whose cross sectional surface decreases with an increasing approach to the seal 34. Said annular chamber 35** forms a throttle point for reducing the dynamic pressures acting on the seal.

During the operation of rotary drive 14 and of the striking device 15, the hammer piston 17 strikes on the rearward end face of the shank 13. At the same time, scavenger under a high pressure of about 10 to 50 bar is fed through the connecting piece 31 to the scavenging pipe 26. The scavenger gets into the shank 23 and from there into the hollow internal pipe string 11. With each blow of the hammer piston 17 on the shank 13, the latter is advanced by some distance while the column of the liquid scavenger first stays as it is due to the inertia. Thus, a short-time high pressure pulse is formed in the scavenging bore 23 which overlies the stationary fluid pressure. By the throttle effect of the annular gap 25, only part of said pressure impact reaches the seal 34. Thus, the risk for the seal to be damaged or pressed out of its annular groove is reduced.

Furthermore, it is to be taken into account that during the blow action, radial displacements or tilting movements of the shank 13 relative to the hammer piston 17 may occur. The small external diameter of the scavenging pipe 26 allowing such a play, without being stressed by shearing forces, no scavenging pipe breaks are caused under the stated pressure shocks. The scavenging bore 23 of the shank 13 is not interrupted by sealing grooves so that the shank is not endangered by the blows of the hammer piston.

A thread section 36 of the internal pipe string 11 is directly screwed into a corresponding internal thread at the front end of the shank 13 so that the channel extending through the internal pipe string 11 is in direct communication with the scavenging bore 23. The scavenger introduced through the internal drilling string 11 as far as to the borehole bottom flows back, together with the bore material, into the annular channel 37 between the internal drilling string 11 and the external drilling string 10 to leave the drilling shaft through the radial discharge openings 38, provided at an adapter 12 which comprises a threaded sleeve 39 screwed onto an external thread of the shank 13, and a threaded sleeve 40 screwed onto the external pipe string 10. Between said threaded sleeves 39 and 40, there are discharge holes 38. The total length of the adapter 12 only consists of length portions of the threaded sleeves 39 and 40 and of the discharge holes 38 through which the backflushed material directly gets into the open air without the need of using a discharge bell or scavenging ring. The external surface of adapter 12 is cylindrical. Between the discharge openings 38 and sleeve 39, the adapter 12 has a partition wall 41 pressing against the front end wall of shank 13 and forming an abutment for the radial deviation of the backflushed material.

In the embodiment of FIG. 5, head 33 contains two frustoconical ends, i.e. the outer diameter of head 33 is increased linearly to the cylindrical area in which the annular groove with the seal 34 is arranged.

The invention is not only applicable to superposed drilling devices in which the external pipe string 10 and the internal pipe string 11 are coupled nonrotatingly and such as to be impact resistant, but it may be also used if the two pipe strings are turned and/or struck independently of each other. In such a case, the shank 13 would be only coupled to the internal pipe while a separate rotary drive and, if necessary, a drive for striking would be provided for the external pipe.

I claim:

1. Superposed drilling device comprising a rotary drive (14) rotatingly driving a shank (13), a hammer drill (15) provided downstream of the rotary drive (14) and whose piston (17) strikes on the shank (13), a scavenging pipe (26) extending through a bore (27) of the piston (17) and projecting into a scavenging bore (23) of the shank (13), a seal (34) being disposed between a wall of said bore (23) and the scavenging pipe (26), characterized in that between said scavenging pipe (26) and said scavenging bore (23), there is an annular chamber (32), and that the scavenging pipe (26) comprises a radially projecting thicker head (33) than said scavenging pipe (26) in which the seal (34) is accommodated.

2. Superposed drilling device as set forth in claim 1, characterized in that, towards the end of the scavenging pipe (26), the head (33) forms with the scavenging bore (23) an annular chamber (35) whose cross section decreases towards the seal (34).

3. Superposed drilling device as set forth in claim 1 characterized in that the external surface of the head (33) is spherical.

4. Superposed drilling device as set forth in claim 1, characterized that also between said scavenging pipe (26) and the bore (27) of the piston (17), there is an annular chamber and means (30) for supporting the scavenging pipe (26) for oscillation relative to the housing (16) of the hammer drill (15).

5. Superposed drilling device as set forth in claim 1, characterized in that the pressure in the scavenging pipe (26) is at least 10 bar.

6. Superposed drilling device as set forth in claim 1, characterized in that the diameter of the scavenging bore (23) is at least 25 mm.

7. Superposed drilling device as set forth in claim 1, characterized in that the shank (13) is directly screwed with an internal pipe string (11), that an adapter (12) is screwed on the shank (13) and connected by screws with an external pipe string (10), and that the external pipe string (10) or the adapter (12) are provided with discharge holes (38) for the backflushed scavenger and bore material.

8. Superposed drilling device as set forth in claim 2, characterized in that the external surface of the head (33) is spherical.

* * * * *